US005943884A

United States Patent [19]

Kobata et al.

[11] Patent Number: 5,943,884

[45] Date of Patent: Aug. 31, 1999

[54] KNITTED SUIT HAVING A DOUBLE LAYER STRUCTURE AND KNITTING METHOD THEREFOR

[75] Inventors: Yoshiyuki Kobata; Masato Suzuki, both of Wakayama, Japan

[73] Assignee: Shima Seiki Manufacturing, Ltd., Wakayama, Japan

[21] Appl. No.: 09/030,427

[22] Filed: Feb. 25, 1998

[30] Foreign Application Priority Data

Feb. 27, 1997 [JP] Japan ..... 9-043623

[51] Int. Cl.[6] ..... D04B 7/10

[52] U.S. Cl. ..... 66/176; 66/69; 66/70; 66/189

[58] Field of Search ..... 66/176, 189, 69, 66/70

[56] References Cited

U.S. PATENT DOCUMENTS 3,640,096 2/1972 Betts et al. ..... 66/176
4,197,724 4/1980 Robinson et al. ..... 66/176
5,257,514 11/1993 Okuno .
5,692,399 12/1997 Takahashi et al. ..... 66/70

FOREIGN PATENT DOCUMENTS 3-75656 12/1991 Japan .

*Primary Examiner*—Andy Falik
*Attorney, Agent, or Firm*—Nikaido, Marmelstein, Murray & Oram LLP

[57] ABSTRACT

On needle beds, an outer fabric and an inner fabric are arranged to oppose each other. Each of the outer fabric and the inner fabric comprises a back body and a left half and a right half of the front body that are arranged on both sides of the back body. The inner fabric and the outer fabric are knitted in a single tubular form from the hem part up to the bottom of armhole. At and beyond the bottom of armhole, it is divided and knitted into three tubular forms; the back body, the right half of the front body, and the left half of the front body. Armholes are provided between tubular forms. At the shoulders, the three tubular forms are united back to one single tubular form, and the back body and the right and left halves of the front body of the outer fabric are joined, and similarly, the back body and the right and left halves of the front body of the inner fabric are joined.

9 Claims, 5 Drawing Sheets

FIG. 3-A
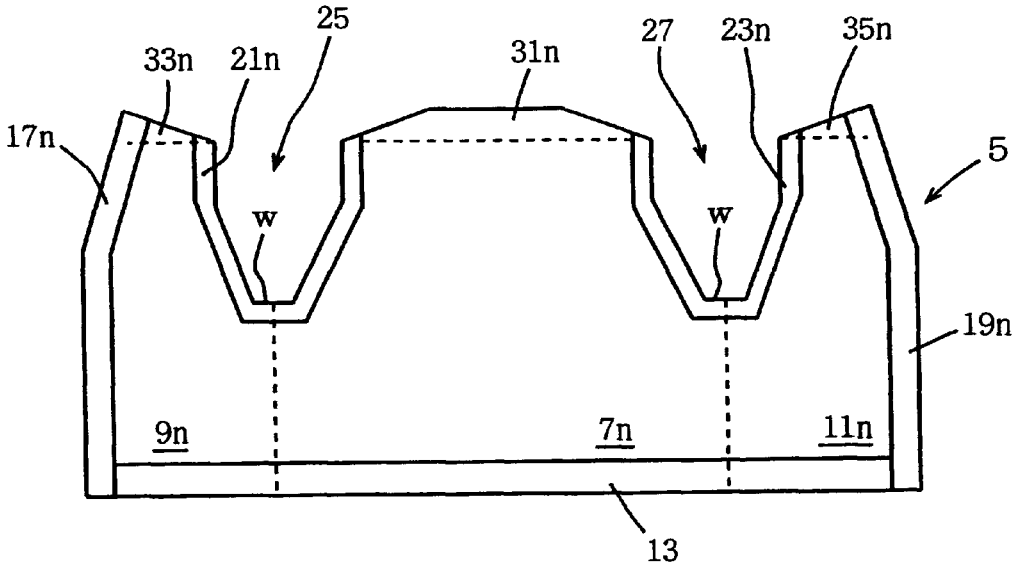
FIG. 3-B
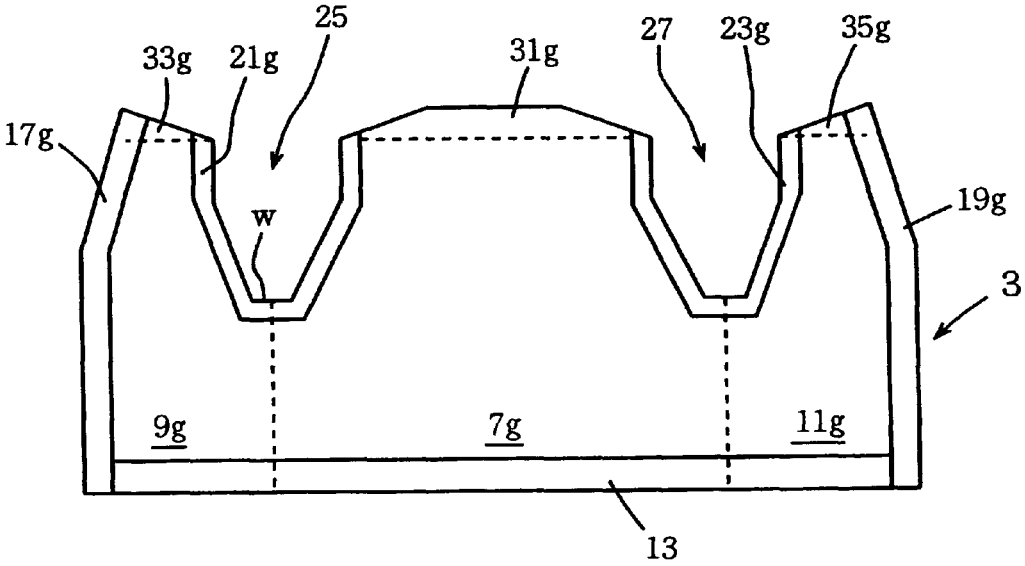

KNITTED SUIT HAVING A DOUBLE LAYER STRUCTURE AND KNITTING METHOD THEREFOR

BACKGROUND OF THE INVENTION

1. Field of the Invention

The present invention relates to knitted clothes wherein the front body and the back body are joined at the side edge portions of the knitting widths and at the shoulders, and a knitting method thereof, and in particular, knitted clothes wherein both the front body and the back body have a double-layered structure with a hollow section, and a knitting method thereof.

2. Prior Art

When the front body and the back body of knitted clothes are knitted and joined on a flat knitting machine to a substantially completed condition, sewing processes such as linking, that were needed in the prior art, can be omitted or reduced. Such technologies are disclosed in, for example, Japanese Patent Hei 3-75,656 and Japanese Provisional Patent Hei 5-51849.

Japanese Patent Hei 3-75,656 was applied by the present applicant, and it uses a flat knitting machine with two needle beds, wherein a pair of needle beds are arranged to oppose to each other, one in the front and the other in the back, and needles of odd numbers are assigned to, for example, a front fabric, and the needles of even numbers are assigned to, for example, a back fabric; thus every other needles of the front and back needle beds are used to knit a fabric in a tubular form. When the front fabric is knitted, the back fabric is made to belong to the needles of the back needle bed, and when the back fabric is knitted, the front fabric is made to belong to the needles of the front needle bed, and knitting is made with the front fabric and the back fabric being overlapped with each other, one in the front and the other in the back. With this arrangement, each fabric is always provided with empty needles for transferring on the opposing needle bed. As a result, structural patterns wherein face stitch and back stitch are mixed with each other, such as links knitting, garter knitting and rib stitch, can be knitted in a tubular form. Further, these empty needles may be used to shift a fabric sidewise to join it with an adjacent fabric. When a flat knitting machine with four needle beds, wherein one more pair of needle beds are added, one in the front and the other in the back, is used, the front fabric can be knitted on the needles of the lower front needle bed and the needles of the upper back needle bed, and similarly, the back fabric can be knitted on needles of the lower back needle bed and needles of the upper front needle bed. Thus, unlike the flat knitting machine with two needle beds, it is not necessary to assign the front fabric to the needles of odd numbers and the back fabric to the needles of even numbers.

Japanese Provisional Patent Hei 5-51849 uses another knitting method to obtain knitted clothes in a nearly completed form. According to this method, a back body is set in the middle of the needle bed, and the left and right portions of a front body are arranged on both sides of the back body, and knitting proceeds from the hem part towards the shoulders. After that, the front body and the back body are joined together at the shoulders to obtain a V neck vest that is close to completion. Further, U.S. Pat. No. 5,379,615 discloses a knitting method for knitting seamless vests.

Both methods mentioned above, however, form fabrics of knitted clothes, such as those of the front body and the back body, in the form of a single layer fabric. Hence knitted clothes that are knitted by these methods, such as vest, have the following problems. When a vest that is knitted in such a way that face stitches come to the outer surface is turned inside out and is used as a reversible one, it simply reveals the back side (back stitches of the same color) of the single layer fabric. It can not present any color, pattern or structure that is independent of those of the face side. Thus there are large restraints in design. Moreover, as the front body and the back body comprise a single layer fabric, the product lacks bulkiness of the fabric.

In the past, to avoid these problems, two single layer fabrics were knitted separately on a flat knitting machine, then they were sewn together along the side edge portions thereof to produce knitted clothes of which front body and back body are hollow in section. As a result, much time and labor were needed to produce knitted clothes of this kind.

SUMMARY OF THE INVENTION

One objective of the present invention is to provide knitted clothes of which components such as front body and back body have a double-layered structure with a hollow section, and a knitting method thereof.

Another objective of the present invention is to enable knitting of knitted clothes of hollow double-layered structure on a flat knitting machine, substantially free of sewing.

A secondary objective of the present invention is to minimize restraints in design of knitted clothes and to produce knitted clothes with volume.

The present invention is a method of knitting a suit of knitted clothes having a double-layered structure comprising an outer fabric and an inner fabric, with use of a flat knitting machine wherein at least a pair of needle beds extending sidewise and opposing against each other, one in the front and the other in the back, are provided; each of the pair of needle beds has a large number of needles, with the pair of needle beds form a trick gap between them. At least one of the pair of needle beds can be racked sidewise, and stitches can be transferred between said pair of needle beds.

The method is characterized in that each of said outer fabric and inner fabric comprises the first half of the body of the suit of knitted clothes, and the second left half and the second right half of the body being arranged on both sides of the first half. The outer fabric is made to belong to the first needle bed, the inner fabric is made to belong to the second needle bed, the second left half and the second right half of the outer fabric are joined with the first half of the outer fabric along the side lines, and the second left half and the second right half of the inner fabric are joined with the first half of the inner fabric along the side lines. The outer fabric and the inner fabric are opposed to each other on the needle beds. The the inner fabric and the outer fabric are knitted as a single tubular form from the hem part up to the bottom of armhole. At at the bottom of the armhole, double stitches are formed by stitch transferring to separate the single tubular form into three tubular forms, a tubular form comprising the first half of the outer fabric and the first half of the inner fabric, a tubular form comprising the second left halves of both the outer and inner fabrics, and a tubular form comprising the second right halves of both the outer and inner fabrics. The separated three tubular forms are knitted up to the bottom of the shoulder to form armholes between the three tubular forms. At the shoulders, the first halves of both the outer and inner fabrics, and the second left halves and the second right halves of the outer and inner fabrics are joined in sequence by shifting stitches and forming double stitches, from both shoulders towards the collar. The stitches of the remaining back collar are then bound off.

According to the present invention, each of the front body and the back body of a suit of knitted clothes has a two-layered structure with a hollow section, comprising an outer fabric and an inner fabric, and they are knitted on a flat knitting machine, with the outer fabric and the inner fabric being knitted together. As a result, there is no need of sewing single-layered fabrics together. Moreover, both the outer fabric and the inner fabric can have completely independent expressions designs in terms of color, material, pattern and knit structure. For example, when a suit of reversible knitted clothes is knitted, its design can be diversified. Further, the present invention can produce bulky knitted clothes with volume. As the knitted clothes thus knitted on a flat knitting machine are not sewn at all, they are free of any stiffness caused by seams, and they can be used as reversible clothes.

BRIEF DESCRIPTION OF THE DRAWINGS

FIG. 3-A and FIG. 3-B show the arrangement and order of knitting of various parts of the vest to be knitted on a flat knitting machine, and FIG. 3-A shows the vest seen from the front of the flat knitting machine, and FIG. 3-B shows the vest seen through from the back of the flat knitting machine.

FIG. 4-1 through FIG. 4-5 show the arrangement of various parts on needle beds and the feeding directions of yarn.

FIG. 5 shows steps of joining by knitting of the right front half body and the back body at the shoulder.

DETAILED DESCRIPTION OF THE PREFERRED EMBODIMENT

An embodiment of the present invention will be described with reference to the drawings.

In this embodiment, knitting of a vest will be explained as an example of knitted clothes. For convenience of explanation, the vest to be knitted is plain in that it has no ornamental patterns, and to be knitted on a flat knitting machine with two needle beds. A flat knitting machine to be used in knitting is one wherein at least a pair of needle beds extending sidewise and opposing against each other, one in the front and the other in the back, are provided, each of said pair of needle beds has a large number of needles, said pair of needle beds form a trick gap between them, at least one of said pair of needle beds can be racked sidewise, and stitches can be transferred between said pair of needle beds. For example, flat knitting machine SWG-V of Kabushiki Kaisha Shima Seiki Seisakusho may be used (SWG-V is a trade name of Shima Seiki).

This vest consists of, as will be explained later, an outer fabric and an inner fabric, and is a reversible vest that can be worn by turning it inside out. Hence the relationship between the outer fabric and the inner fabric and the relationship between the right body and the left body will be reversed by the way it is worn. In the present specification, the outer fabric and the inner fabric are defined by the condition shown in FIG. 1.

Figure 1:
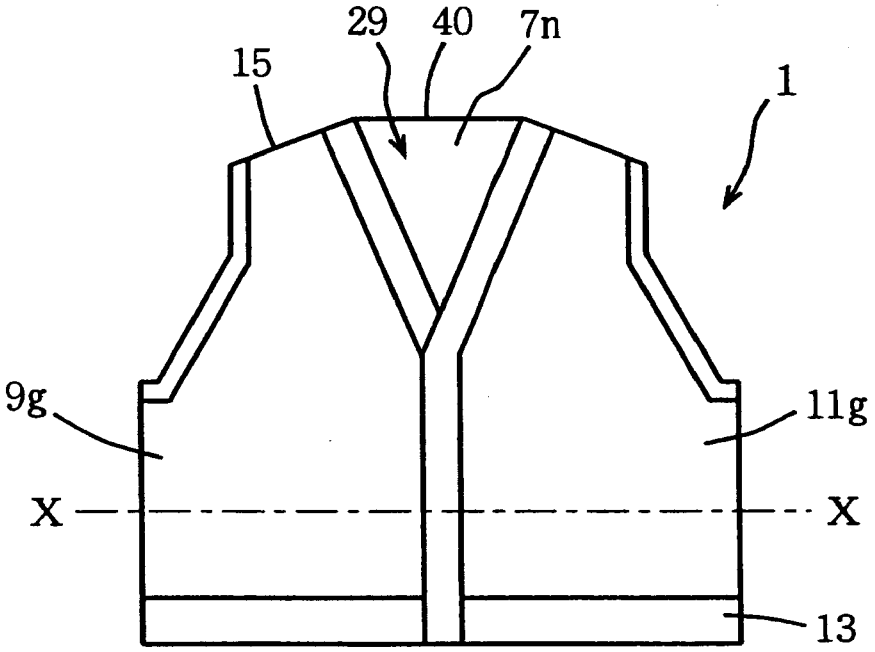
FIG. 1 shows a vest knitted in an embodiment.
Figure 2:
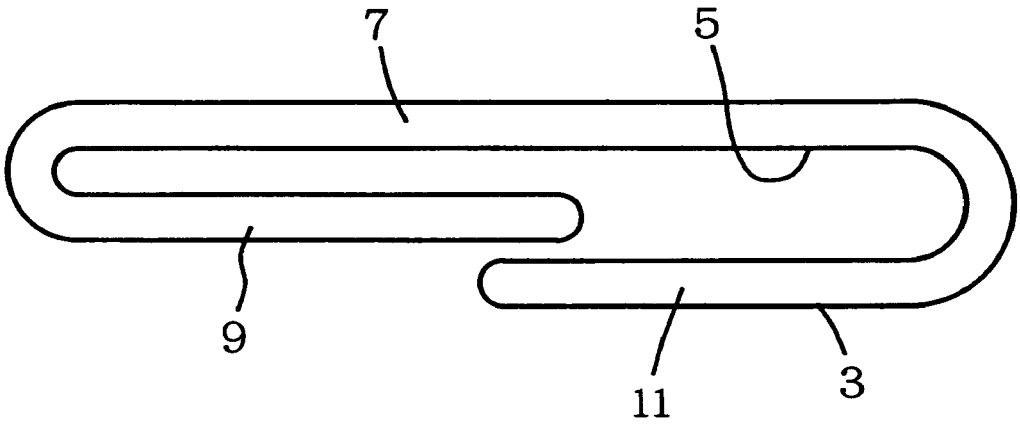
FIG. 2 shows the section of the vest along the line X—X of FIG. 1.
Figures 1, 2, 3, 4, 5:
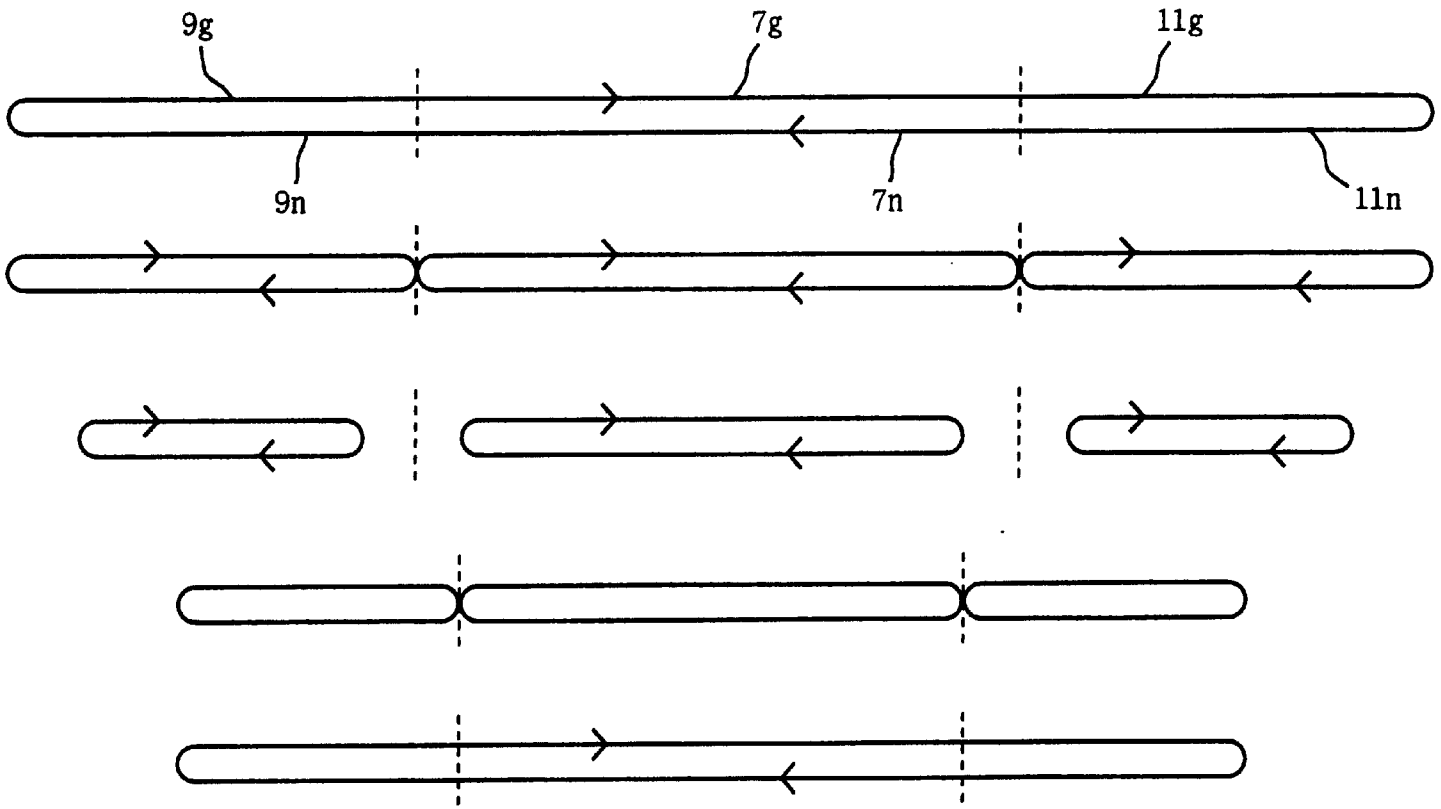
Figure 5:
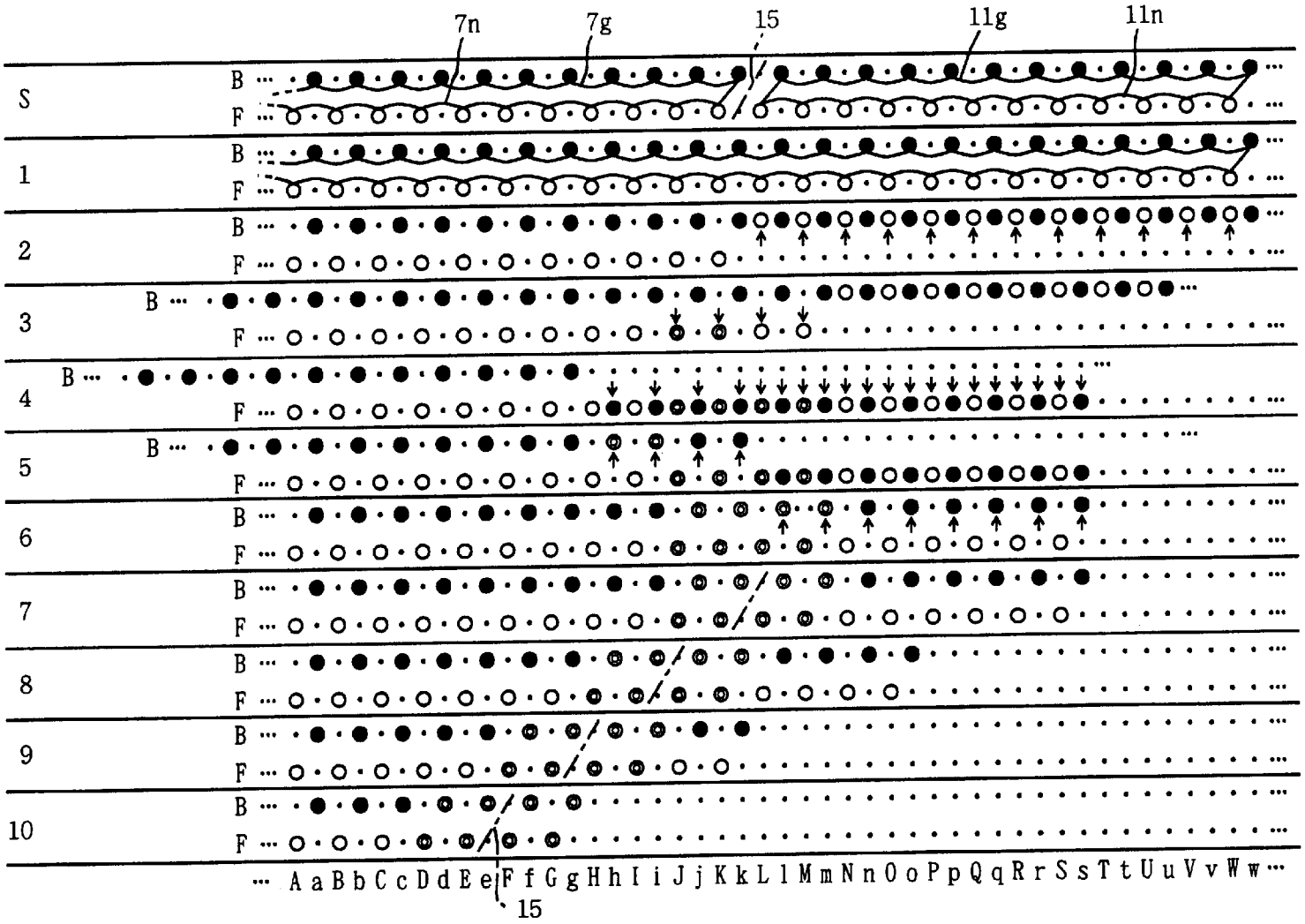

FIG. 1 through FIG. 3 shows a vest 1, as an example of knitted clothes. FIG. 1 shows the vest in its completed condition. FIG. 2 shows the section of the vest along the line X—X of FIG. 1. FIG. 3 shows the arrangement and knitting order of various parts of the vest to be knitted on a flat knitting machine (not illustrated), and FIG. 3-A shows the vest seen from the front of the flat knitting machine, and FIG. 3-B shows the vest seen through from the back of the flat knitting machine. As can be seen clearly from these diagrams described above, the vest 1 comprises an outer fabric 3 and an inner fabric 5, and is made of fabrics of two-layered structure with a hollow section. Here, the outer fabric 3 means the fabric that appear on the outer side when the vest 1 is worn, and the inner fabric 3 is the fabric that is concealed inside. The inner fabric 5 is knitted such that it belongs to the front needle bed, and the outer fabric 3 is knitted such that it belongs to the back needle bed. The inner fabric 5 comprises a right front half body 9*n*, a back body 7*n* and a left front half body 11*n*, and they are mainly knitted on the needles of the front needle bed of the flat knitting machine. Both the inner fabric 5 and the outer fabric 3 are knitted on the two needle beds. When all stitches are plain, however, as shown in FIG. 5, inner fabric 5 is held on the front needle bed and outer fabric 3 is held on the back needle bed. This relation is represented such that the front fabric belongs to the front bed, and the back fabric belongs to the back bed, and all of the stitches are plain stitches in a "standard" operation. The outer fabric 3 comprises a right front half body 9*g*, a back body 7*g* and a left front half body 11*g*, and they are mainly knitted on the needles of the back needle bed. As a result, face stitches appear on the surfaces of the outer fabric 3 and inner fabric 5. Knitting of the vest 1 is started from a hem part 13 of rib stitch, plain stitch, etc., and continued towards the shoulder lines 15. Marks 17, 19, 21 and 23 in the diagram indicate edges of the body, such as plackets and circumferences of armholes, that are knitted for reinforcement, with, a knitted structure such as links knitting and garter knitting, and their knitting description is omitted.

Next, knitting of the vest 1 in this embodiment will be described. FIG. 4 shows the arrangement of various parts on the needle beds and the feed direction of yarn in various stages of knitting. As shown in FIG. 4-1, knitting of the vest 1 is started from a hem part 13 of rib stitch or plain stitch, and for example, the yarn is shifted to the right to feed the yarn to needles holding the outer fabric 3 of the vest, in the order of the right front half body 9*g*, the back body 7*g* and the left front half body 11*g*, then the yarn is shifted to the left to feed the yarn to needles holding the left front half body 11*n*, the back body 7*n* and the right front half body 9*n* constituting the inner fabric 5 to form stitch courses on the respective parts. When this circular knitting is repeated, the inner fabric 5 and the outer fabric 3 will form a tubular structure wherein they are joined at their edge portions. Thus the hem part 13 of a desired length is formed. Next, in succession to knitting of the hem part, just like the hem part, the yarn is circular-knitted to knit the outer fabric and the inner fabric of the body up to a point just short of the formations of the armholes 25, 27. At the same time, plackets 17, 19 are knitted adjacent to the hem part 13, etc. If buttonholes are needed, they may be formed by knitting in a placket.

At the bottom of armhole w, stitches of the relevant portions of the inner fabric 5 and the outer fabric 3 are overlapped with each other by transferring, and after that, publicly known binding-off is made to release stitches at the bottom of armhole w from the needles. This binding-off repeats knitting from one bottom of armhole to the other or from one bottom of armhole to both directions, said knitting comprising the following steps: for example, at the bottom of armhole w, a stitch of the inner fabric and a stitch of the outer fabric are overlapped with each other to form a double stitch, a new stitch is formed on this double stitch, the newly formed stitch is overlapped with adjacent stitches of the inner fabric and the outer fabric, and a next stitch is formed on this double stitch, then the stitch is overlapped with adjacent stitches . . . . As a result, the front body and the back body are divided from each other, with the bottom of armhole w being the dividing line.

Beyond the bottom of armhole w, each of the back body 7, the right front half body 9 and the left front half body 11 is knitted as a fabric of tubular two-layered structure comprising the inner fabric and the outer fabric joined together. To this end, in the embodiment, the yarn that has been used up to now is used for knitting the back body, and two yarns are newly introduced to knit front half bodies 9, 11. FIG. 4-2 shows the yarn feeding conditions to the respective parts beyond the bottom of armhole w. To knit the respective parts in tubular forms, and at the same time to widen the openings 25, 27 of armholes, a stitch or stitches of edge portions of the front half bodies 9, 11 and the back body 7 are shifted towards the inner side of the fabrics and the knitting width of the body is reduced. In this way, the knitting is continued to the shoulder. During this process, the opening of neckhole 29 is formed in a similar manner. The state of holding of the fabrics on needle beds when knitting is completed short of the shoulders is shown in FIG. 4-3.

To join the front half bodies 9, 11 and the back bodies 7 while forming stitch courses of the shoulders 31*n*, 31*g*, 33*n*, 33*g*, 35*n*, 35*g*, stitches of the front half bodies 9, 11 that are separated by the arm holes 25, 27 from the back body 7 are shifted, by transferring, to positions next to the back body 7. In the case of a flat knitting machine of which needle bed racking is small, this shifting of front half bodies 9, 11 must be divided into plural shifts. In this case, stitches of the same course are transferred many times between the front and back needle beds. To avoid this, while the above-mentioned neckhole 29 and armholes 25, 27 are formed, whenever a specified number of stitch courses of the body are formed, the stitches of the front half bodies 9, 11 are shifted sequentially towards the back body 7. With this arrangement, when knitting up to the shoulders is completed, the state of FIG. 4-3 is realized, and there is no need of transferring stitches of the same course many times. Thus the loads to the stitches are reduced. FIG. 4—4 shows the state of stitch holding when the front half bodies 9, 11 are shifted next to the back body 7.

Next, joining by knitting between the front half bodies 9, 11 and the back body 7 will be described. A single yarn is used in joining by knitting, and other yarns are excluded from this knitting. The yarn is fed circularly to the needles holding the right front half body 9*g*, back body 7*g* and left front half body 11*g* of the outer fabric 3 and the needles holding the left front half body 11*n*, back body 7*n* and right front half body 9*n* of the inner fabric 5 to form stitch courses and in turn obtain a single tubular fabric in which the respective parts are joined together (FIG. 4-5).

As both the right front half body 9 and the left front half body 11 are joined with the back body 7 in a similar manner, joining by knitting between the left front half body 11 and the back body 7 will be described with reference to FIG. 5. Step S shows the state of holding, on the needle beds, of stitches of the inner fabric 5 and the outer fabric 3 of the back body 7 and the left front half body 11 before joining. Alphabetic letters shown in the bottom of the diagram indicate needles of the needle beds. In the state of step S, the needles A~w of the front needle bed and the needles A~w of the back needle bed are directly opposing to each other. F and B shown in each step indicate the front needle bed and the back needle bed, respectively. Black dot indicates a stitch of the outer fabric, and white dot indicates a stitch of the inner fabric.

First, in step 1, the yarn is fed circularly to the needles holding the right front half body 9*g*, back body 7*g* and left front half body 11*g* of the outer fabric 3 being held on the back needle bed, then to the needles holding left front half body 11*n*, back body 7*n* and right front half body 9*n* of the inner fabric 5 being held on the front needle bed to form stitch courses of the shoulders 31, 33 and 35. This joins various parts together to form a single tubular fabric.

The formed stitches of the left front half body 11*n* of the inner fabric are transferred to the back needle bed (step 2), after that, the back needle bed is racked to the left, four stitches of the edge portion of the left front half body 11*n* being next to the back body 7 (stitches that were held on the needles L, M, N and O of the front needle bed in step 1) are transferred to the front needle bed, and the two stitches of the edge portion that were held on the needles L, M are overlapped with two stitches of the edge portion of the back body 7*n* (step 3). In step 4, the back needle bed is racked further to the left, and the remaining stitches of the left front half body 11*n* are transferred to the front needle bed. By this, double stitches are formed with the stitches that were held on the needles N, O in step 1. At the same time, in this step, stitches of the left front half body 11*g* of the outer fabric are transferred to the front needle bed. Next, in step 5, the back needle bed is racked to the condition shown in the diagram, and four stitches of the edge portion of the left front half body 11*g* that were held on the needles l, m, n and o in step 1 are transferred to the back needle bed, and two stitches of the edge portion are overlapped with two stitches of the edge portion of the back body 7*g*. In step 6, the back needle bed is racked to the right, and the stitches of the left front half body 11*g* being held on the front needle bed are transferred to the back needle bed. By this, double stitches are formed with the stitches that were held on the needles n, o in step 1. Step 7 shows the state of holding the fabrics on the needle bed just after the completion of step 6. Through the knitting of the steps 1~6 above, in both the left front half body 11 and the back body 7, two stitches of the adjacent edge portions form double stitches. Thus the knitting widths of the tubular knitted fabric are reduced by four wales in the front and the back on the right of the fabric.

Knitting of steps 1~6 is repeated to knit the shoulders 31, 33, 35 of the front half bodies and the back body, join the shoulders together, and release stitches from the needles sequentially. In the course of repeating this process of knitting, in knitting a stitch course of step 1, to form stitches of plural stitch courses on needles holding double stitches, after the yarn is reversed at a relevant point, the yarn may be reversed again to be fed. This will reduce the stiffness in the shoulder line of the fabric. Steps 7~10 correspond to steps 1~6, respectively, showing the states of holding the fabrics in the respective stages.

As described above, stitches of the front half bodies 9, 11 are overlapped with the back body 7 along the shoulder lines 15, then subsequent stitch course of the respective parts are formed, and stitches of wales having double stitch with a stitch of the front half body are shifted towards the inner side of the fabric. This process is repeated. As a result, the front half bodies 9, 11 and the back body 7 can be joined together while the knitting widths of the front half bodies and the back body are reduced at the same time. In the above-mentioned case, when the shoulders 31, 33, 35 are formed, the knitting widths of the front half bodies and the back body are reduced sequentially. As a result, the outer ends of the shoulders will drop. According to the method of FIG. 5 mentioned above, fabrics of the same layer, namely, the front half bodies and the back body of the outer fabric or of the inner fabric are joined at the shoulders. This has an effect that the front half bodies and the back body maintain a hollow structure even along the shoulder lines.

Figure 6:
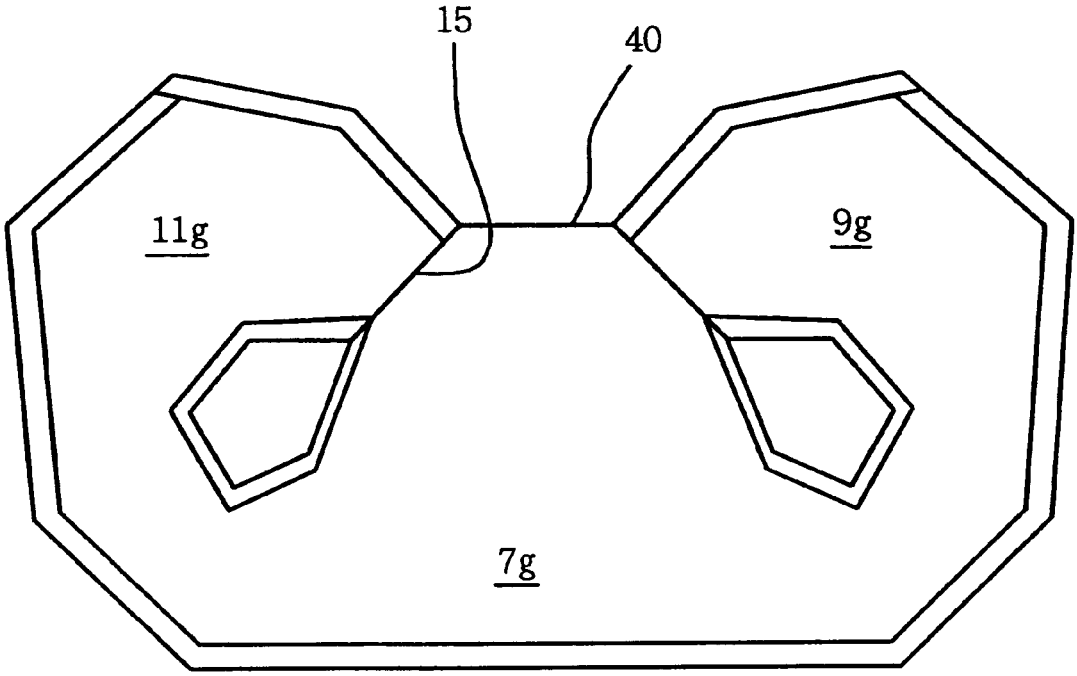
FIG. 6 shows the spread vest seen from above.

After completion of joining between the back body and the front half bodies at shoulders, the inner fabric and the outer fabric of the back collar 40 of the back body 7 being held on needle beds are overlapped with each other by transferring, next, the stitches are bound off sequentially, and stitches are released from needles to complete knitting. The vest of this condition, which is close to completion, is taken out the flat knitting machine. FIG. 6 shows the vest 1 knitted in the above-mentioned manner, in a spread state. It is seen from above.

With regard to joining by knitting between the front body and the back body at the shoulders, in place of the above-mentioned method, for example, the binding-off method proposed earlier by the present applicant and disclosed in Japanese Provisional Patent Hei 3-279447 (U.S. Pat No. 5,257,514) may be used, as will be described below. After the completion of knitting of the front body and the back body up to the shoulders, the stitches of the final course of the outer fabric of the front body and opposing stitches of the final course of the inner fabric thereof are overlapped with each other by transferring to make a single layer of fabric. In a similar manner, the back bodies are made into a single layer of fabric. After that, the fabric of the front body is transferred to the needle bed opposite to one on which the fabric of the back body is held. A stitch of the front body is overlapped with a stitch of the edge portion of the back body, and after that, a new stitch is formed on this double stitch, and the newly formed stitch and stitches of the front body and the back body adjacent to them are overlapped with each other, and over this double stitch a new stitch is formed, and this stitch and the adjacent stitches of the front body and the back body are overlapped with each other. These processes are repeated. In this way, stitches of the front body and the stitches of the back body, that are symmetrical to each other across the armhole, are overlapped with each other and the two fabrics are joined together. According to this method, the outer fabric and the inner fabric are overlapped with each other at the shoulders. Thus the hollow structure of the fabrics is disrupted at the shoulders. When a silhouette of dropping shoulders is desired, the shoulders 31, 33, 35 are formed by flechage, then the above-mentioned binding-off knitting is used.

In the above-mentioned embodiment, the outer fabrics and the inner fabrics of various parts of the front body and the back body are circular-knitted by using the same yarn. However, the outer fabric and the inner fabric may be knitted as independent designs with yarns of different colors and/or different materials. In such a case, to join the outer fabric and the inner fabric at their edge portions, for example, yarns may be entangled with each other. Entangling of yarns is a popular technique that has been used over many years in knitting tubular plain stitch jacquard. Yarns are arranged to entangle with each other at edge portions of the fabrics, and a yarn beneath a cross is knitted to entangle with the other yarn.

A filling material such as down may be filled in the hollows between the outer fabric and the inner fabric of the knitted suit of knitted clothes having the two-layered structure to obtain a knitted down vest. In such a case, to keep the filled material in the designed positions under various conditions of wearing, the outer fabric and the inner fabric may be knitted to form a grid, by for example tuck stitch, partitioning various parts. Thus the present invention may be modified as far as it does not deviate from the gist of the invention.

We claim:

1. A method of knitting a suit of knitted clothes having a double-layered structure comprising an outer fabric and an inner fabric, with use of a flat knitting machine wherein at least a pair of needle beds extending sidewise and opposing against each other, one in the front and the other in the back, are provided, each of said pair of needle beds has a large number of needles, said pair of needle beds form a trick gap between them, at least one of said pair of needle beds can be racked sidewise, and stitches can be transferred between said pair of needle beds, wherein each of said outer fabric and inner fabric comprises a first half of the body of the suit of knitted clothes, and a second left half and a second right half of the body being arranged on both sides of the first half;

a: said outer fabric and said inner fabric are knitted on said pair of bed needles, the second left half and the second right half of the outer fabric are joined with the first half of the outer fabric along first side lines thereof, and the second left half and the second right half of the inner fabric are joined with the first half of the inner fabric along second side lines thereof, and the outer fabric and the inner fabric are opposed to each other on the needle beds;

b: the inner fabric and the outer fabric are knitted as a single tubular form from a hem part up to a bottom of armholes;

c: at the bottom of the armholes, double stitches are formed by stitch transferring to separate said single tubular form into three tubular forms, a first tubular form comprising the first half of the outer fabric and the first half of the inner fabric, a second tubular form comprising the second left halves of both the outer and inner fabrics, and a third tubular form comprising the second right halves of both the outer and inner fabrics, and the separated three tubular forms are knitted up to bottoms of shoulders to form the armholes between said three tubular forms;

d: at the shoulders, the first halves of both the outer and inner fabrics, and the second left halves and the second right halves of the outer and inner fabrics are joined in sequence by transferring stitches to form double stitches, from both shoulders towards a collar; and e: stitches of a remaining back collar are bound off.

2. A knitting method as recited in claim 1, wherein, in said step d, stitches of the first half of said outer fabric and stitches of the right and left second halves of the outer fabric are overlapped with each other, and stitches of the first half of said inner fabric and stitches of the right and left second halves of the inner fabric are overlapped with each other.

3. A knitting method as recited in claim 1, wherein, in said step d, stitches of the right and left second halves of the outer fabric and stitches of the right and left second halves of the inner fabric are overlapped with each other, and the overlapped stitches of the right and left second halves are overlapped with stitches of the first halves.

4. A knitting method as recited in claim 1, wherein said first halves are back bodies and said right and left second halves are right and left front bodies.

5. A knitting method as recited in claim 1, wherein the outer fabric and the inner fabric are knitted with different yarns, respectively, and the outer fabric and the inner fabric are connected with each other along side edges of said respective tubular forms by crossing said different of the yarns with each other.

6. A knitting method as recited in claim 1, wherein the outer fabric and the inner fabric are knit with independent designs.

7. A suit of knitted clothes having a two-layered structure with a hollow section, comprising an outer fabric and an inner fabric, wherein each of the outer fabric and the inner fabric comprises a right half of a front body, a back body, and a left half of the front body, the outer fabric and the inner fabric are knitted together along both edge portions from a hem part up to armholes, from the armholes to edges of shoulders, the back bodies of the outer fabric and the inner fabric, the right halves of the front bodies thereof, and the left halves of the front bodies thereof are knitted together in tubular forms, respectively, at the shoulders, the front bodies and the back bodies of the outer fabric and the inner fabric are joined together, and stitches of a back collar are bound off.

8. A suit as recited in claim 7, wherein different yarns are used for the outer fabric and the inner fabric, and the different yarns are crossed with each other at boundaries between the inner and outer fabrics such that the different yarns are entangled in said portions that are knitted together.

9. A suit as recited in claim 7, wherein at the shoulders of said outer fabric, the right half and the left half of the front body thereof are joined with the back body thereof by means of first double stitches, and at the shoulders of the inner fabric, the right half and the left half of the front body thereof are joined with the back body thereof by means of second double stitches.

* * * * *